US005906547A

United States Patent [19]

Tynan

[11] Patent Number: 5,906,547

[45] Date of Patent: May 25, 1999

[54] GOLF SIMULATION SYSTEM

[76] Inventor: Richard M. Tynan, 812 Arcadia Ave., Vista, Calif. 92084

[21] Appl. No.: 08/840,265

[22] Filed: Apr. 14, 1997

[51] Int. Cl.[6] ..... A63B 69/36

[52] U.S. Cl. ..... 473/199; 473/200; 473/222

[58] Field of Search ..... 473/131, 133, 473/139–141, 150–155, 198–200, 266–268, 270, 407, 409; 463/30–31, 36; 364/410; 434/247, 252, 307 R

[56] References Cited

U.S. PATENT DOCUMENTS

| | | | |
|---|---|---|---|
| 4,136,387 | 1/1979 | Sullivan | 473/200 |
| 4,137,566 | 1/1979 | Haas et al. . | |
| 4,158,853 | 6/1979 | Sullivan et al. . | |
| 4,160,942 | 7/1979 | Lynch et al. | 473/156 |
| 4,163,941 | 8/1979 | Linn, Jr. | 473/409 |
| 4,542,906 | 9/1985 | Takase et al. | 473/152 |
| 4,767,121 | 8/1988 | Tonner | 473/141 |
| 5,282,629 | 2/1994 | Eckstein | 473/133 |
| 5,342,054 | 8/1994 | Chang et al. | 473/156 |
| 5,472,205 | 12/1995 | Bouton | 473/409 |
| 5,501,463 | 3/1996 | Gorbush et al. | 473/199 |

*Primary Examiner*—Jessica J. Harrison
*Assistant Examiner*—Mark A Sager

[57] ABSTRACT

This system combines television and computer technology to permit one or more golfers to play a highly realistic round of golf from tees to greens. Each golf clubhead has color-coded bars on the rear lower and outer surfaces. As the clubhead approaches the ball it is multiply strobed and the images of the bars recorded on two color TV cameras perpendicular to each other and to the clubhead direction of travel. The resulting TV color images are digitized and transmitted to the computer. The stroke and club data implicit in the images are sufficient to permit computing the ball's total trajectory on the ground and cause it to be projected on the TV screen as the golfer would see it in actuality. The trajectory is superimposed on a TV view of the hole from the golfer's position. The ball's final position on a map of the hole is used to determine the TV view presented on the screen for his next stroke.

1 Claim, 5 Drawing Sheets

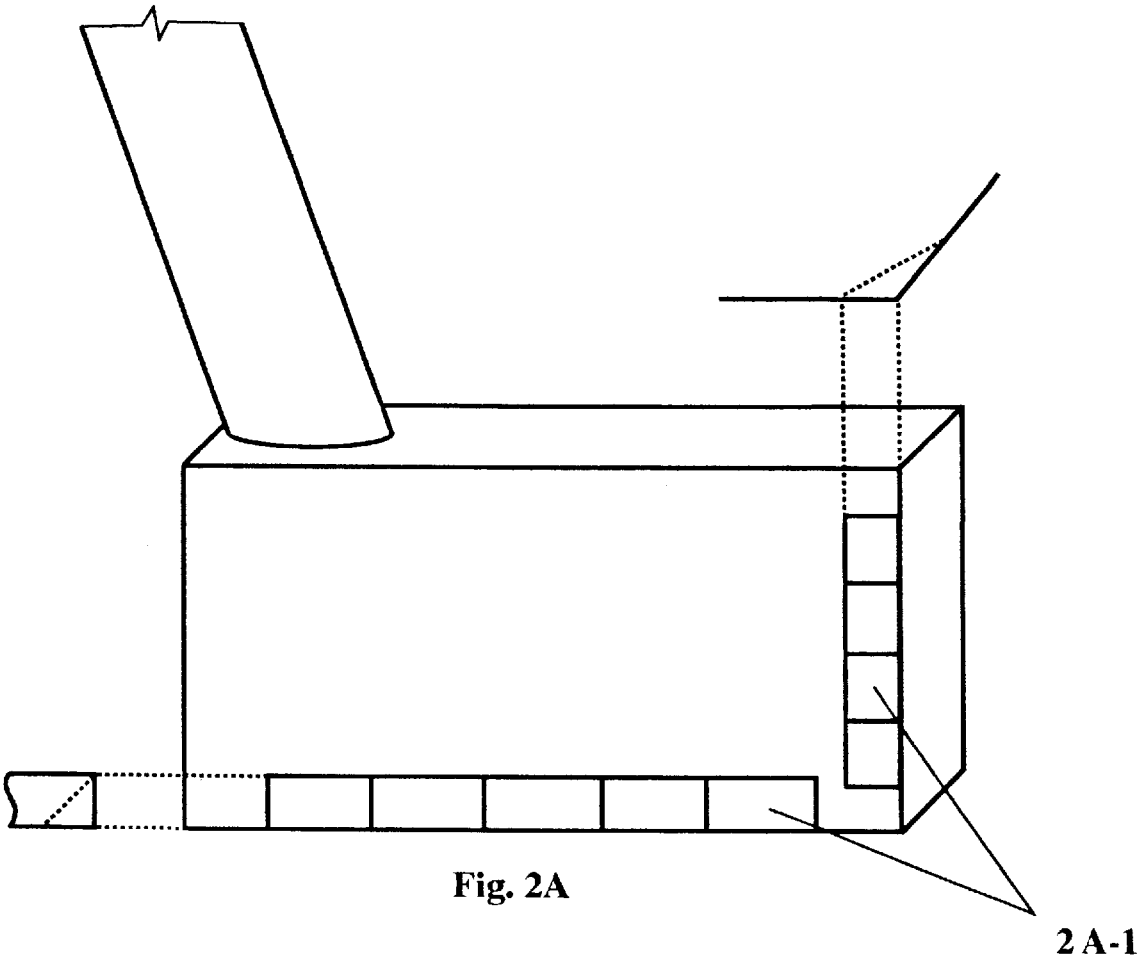
Fig. 2A
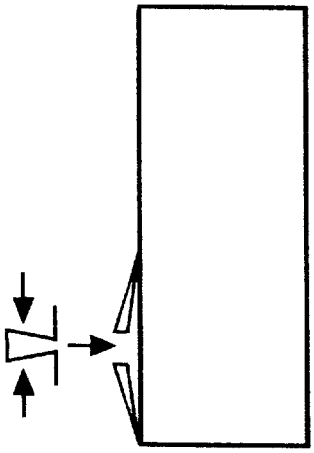
Fig. 2B
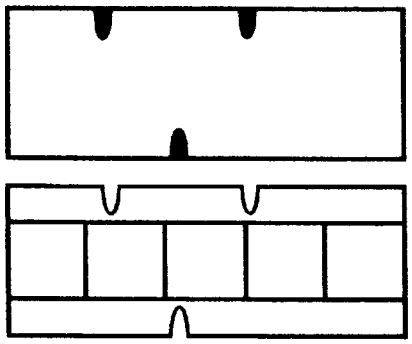
Fig. 2C
Fig. 2

GOLF SIMULATION SYSTEM

BACKGROUND

1. Field of Invention

My invention includes both television and computer technology. As a golf clubhead approaches a simulated golf ball, it is illuminated by three flashes of a stroboscope and the images are registered on two color TV cameras. The images are converted into digital data, analyzed by a computer, and used to control a light spot on a TV screen to simulate the ball's trajectory as seen by the golfer. The trajectory is superimposed on a view toward the hole from the golfer's position. When the player is next up the view changes to a view of the hole from approximately the ball's new position.

2. Description of Prior Art

The systems proposed in the two patents described below have some similarity to that described in this patent application. These patents are included by reference in this application.

Gobush et al, U.S. Pat. No. 5,501,463: The intent is to measure the parameters of a golf stroke and to display the measurements to the stroker for his instruction. Since the system is portable, the system calibration unit of Gobush FIG. 6 must be used at every set-up to define the geometric relationship of the measurement system to the measurement volume immediately behind the ball. The clubhead calibration unit of Gobush FIG. 7 must then be employed to define the clubhead parameters of the club to be used. As shown in Gobush FIG. 5, the clubhead has at least two spots on its outer surface and one facing outward on the shaft perhaps 1 inch above the clubhead.

In Gobush FIG. 4, two TVs (18, 19), each with two flanking strobes (21, 22, 23, 24) are located perhaps 75 cm from the ball. The TV fields of view converge to form a measurement volume extending perhaps 15 cm behind the ball. A sensor is located behind the measurement volume to detect the onslaught of the club. The sensor detects the clubhead as it approaches the edge of the measurement volume. The strobes of both cameras are simultaneously triggered twice with the intent of producing in the TV cameras the images shown in Gobush FIG. 8. Since there is no provision for adjusting the timing of the initial strobe flash or the interval between it and the second, the range of measurement of the clubhead velocity and other clubhead parameters is limited by the resolution of the TV cameras. Within this limitation it is claimed that the two TV images may be used to compute stroke parameters.

Tonner, U.S. Pat. No. 4,767,121: Only this patent's display system has any relevance. As shown in Tonner FIGS. 10 and 11, a map of the hole is displayed on a TV screen. When a "ball" is hit, its ground track (apparently one of seven possible tracks as determined by the system's measurement of the ball's impact and direction), yardage and and final position are displayed. The final position is simply where it first impacts the terrain. Apparently there is one correct physical direction (e.g. one correct track), the same for all shots, in which the player should hit the ball. When hit, the ball's ground track is traced on the screen as determined by the measurement system. The foregoing has only a slight resemblance to the proposed system.

SYSTEM COMPARISONS

The differences between my system and Gobush are:

My system uses permanent or detachable color-coded bars extending along the lower rear and outer rear edges of the clubhead as shown in FIG. 2 of this application. When strobed from the rear, the bars are so angled as to be highly visible respectively from the X-Y TV color camera below and the Y-Z TV color camera to one side.

The clubhead sensors, FIG. 3, sense the clubhead onslaught and measure its approximate velocity along the X-Y TV's Y axis. This is used to control the timing of the initial strobe flash and its frequency and duty cycle. This permits use of the full camera field of view for all clubhead velocities. Consequently the system can measure accurately the parameters of strokes at very different velocities.

The two TV cameras are positioned at right angles to each other and to the general direction of clubhead travel, as are the color-coded bars on the clubhead. As compared to Gobush, this arrangement greatly simplifies measurements and computations.

On the two TV cameras of my system, the positions and angles of the bar images implicitly indicate clubhead velocity and acceleration, direction of travel, vertical and horizontal positions as they change, hook/slice and pitch angles as they change. The positions of the bar images and the bar color coding indicating the club type and brand are digitized and transmitted to the computer to define these parameters explicitly. Their values at the last strobe are extrapolated to determine their values as the clubhead strikes the ball. These and other data are used to determine the ball's complete trajectory. This is presented as the golfer sees it on a view of the hole from the golfer's location. When next up, the golfer in essence is moved up to see a view toward the hole from approximately the ball's new location. Gorbush simply provides digital readouts of stroke parameters.

Owing to the profoundly different measurement techniques, the mathematics used to derive the parameters of clubhead motion, direction, etc. as it hits the ball are equally different.

The obvious differences between the proposed system and Tonner are:

The view of the hole in Tonner is simply a map that does not change. In my system the player's view of the hole is in perspective as the golfer would see it on the ground. Before each player's stroke the view changes to present a view of the hole from the final position of his previous shot.

Tonner simply traces out the ground track of the shot from present position to point of first impact with terrain. For internal use my system computes ground track from present position to final position after bounces and rollout and uses these and other data to present the total trajectory as it would be seen by the golfer.

FIGURES—SUMMARY

FIGS. 2A, 2B, 2C show a golf clubhead with the two color-segmented bars needed for system operation.

OPERATION

Figure 1:
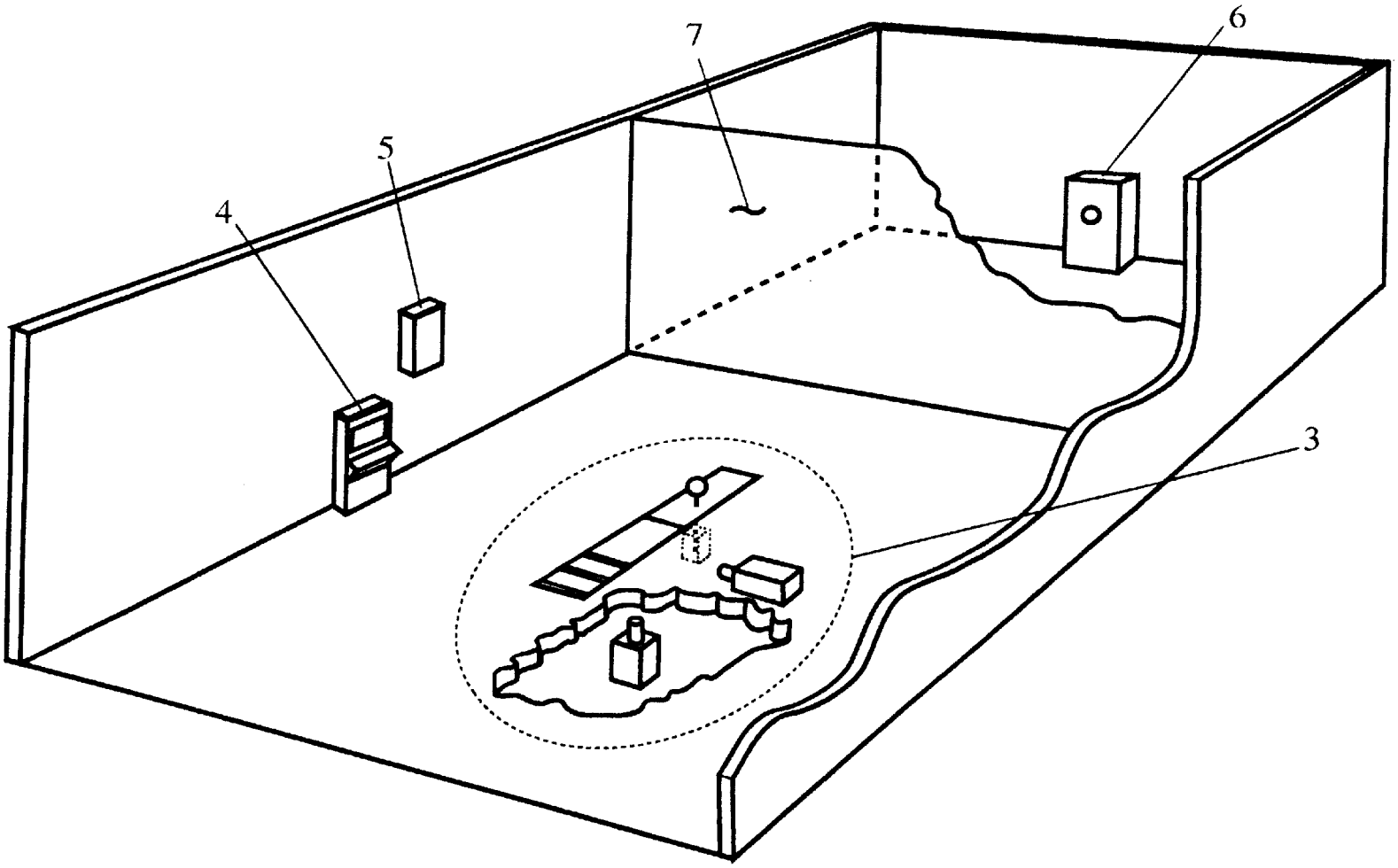
FIG. 1 shows all elements of the system except the barred golf clubs and a remotely located computer and associated video storage unit that serve perhaps 100 venues.

FIG. 1: This figure shows a single station layout. A central computer and coupled video storage unit (not shown) are remotely located and can serve perhaps 100 stations The stroke measurement unit electronic functions (not shown) are executed locally. The clubhead (not shown here, see FIGS. 2A, 2B, 2C) has two color-segmented bars, one along its rear bottom edge and the other on its outer surface. The stroke measurement unit (3) consists of clubhead sensors, a stroboscope, a strobe control, a transparent plate, an X-Y color TV camera to register the horizontal locations of the clubhead at the three strobe flashes, a Y-Z color camera to register the vertical locations of the clubhead at the three strobe flashes, and a tethered ball on a computer-controlled variable-height post and surrounding "grass" (see FIG. 3).

The players use a manual input unit (4), a simple keyboard and display with menus, to enter initial and other data to the computer and control the course of the game if desired. Several golf courses will be available. Among the options available are: golf course, hole and view to be played, golf brand and club used (overrides clubhead color codes), wind conditions. The display and printer unit (5) first displays the player up, his distance to the hole, his score, and wind force and direction. After his stroke, the display indicates all stroke parameters, yardage, new score. The rear-projection color TV (6) or equivalent TV display unit is controlled by the computer and video storage unit first to present on the screen (7) a view of the hole corresponding to the location of the player's ball. Then, almost instantly after each stroke, the computer causes the TV to superimpose on this view the golfer's view of the ball as it traces out its trajectory in accordance with the club and stroke measurement data, terrain, course condition and wind. At the conclusion of the game the printer provides for each player stroke and score data on each hole and final position for each hole on a putting green. The players then proceed to the green, place their balls per the recorded final position for each hole, and putt to finish the game.

FIGS. 2A, 2B, 2C: These clubs have all the capabilities of standard golf clubs and can be used equally well in the field. They differ from standard clubs in that they have color-segmented bars, straight or curved, in or on the lower rear and outer rear edges or surfaces of the clubhead. These may be permanent or may be adhered to or inserted in the clubhead in a variety of ways, one of which is shown. If inserted, they may be keyed with notches in the bars and protrusions on the clubhead or vice versa such that only the appropriate color bar can be inserted in the clubhead. Conversely, "skeleton" color bars can be used to have the same club counterfeit other clubs.

A sequence of colors in the color bars constitutes a code identifying both the type and brand of club. Data defining the performance of clubs by type and brand are stored in the computer and contribute to computing ball trajectory. The strobe illumination, the colors of the bars and the TV tube sensitivity may all be outside the visible spectrum.

Figure 3:
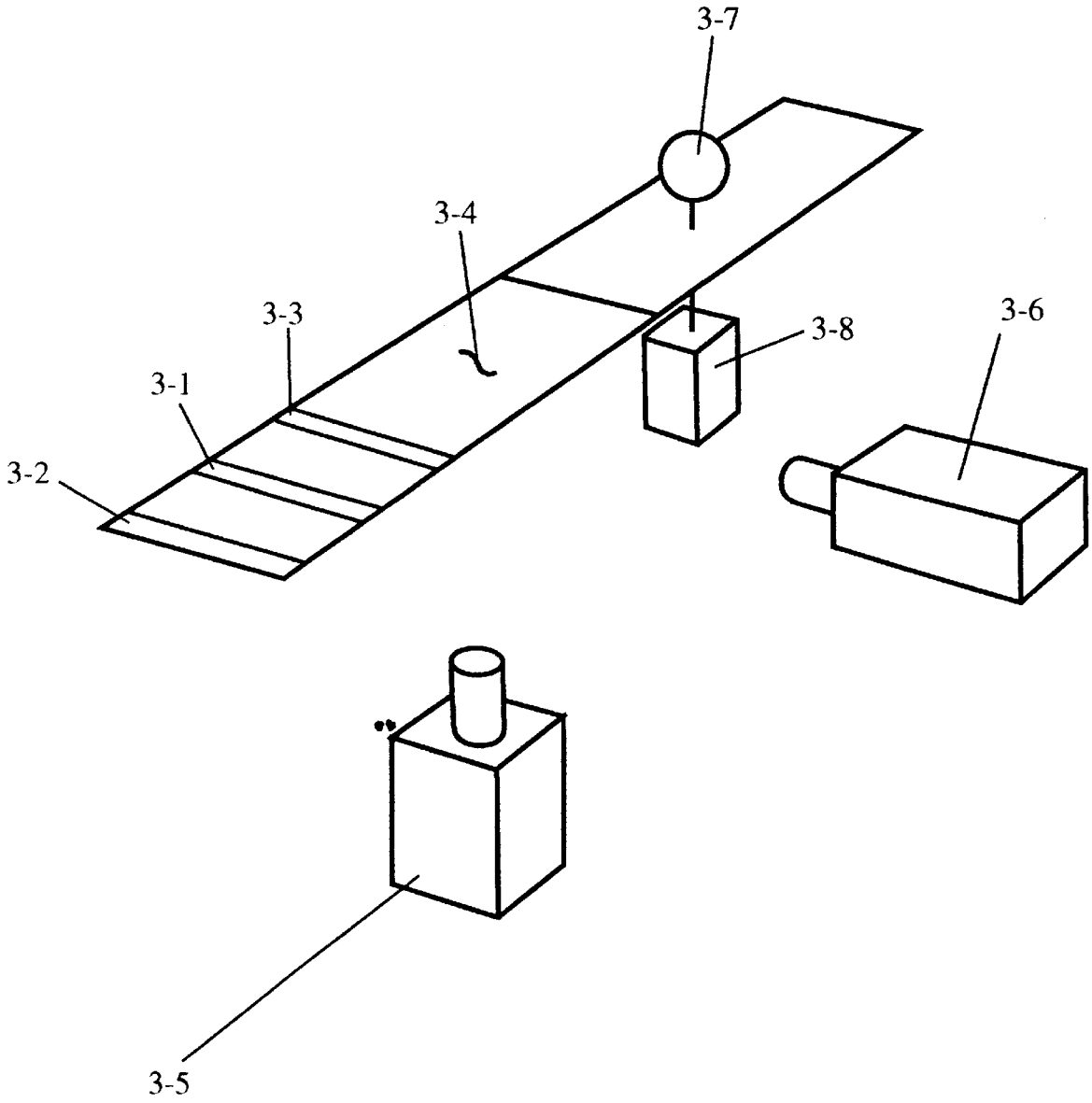
FIG. 3 shows the stroke measurement system. This consists of clubhead sensors that detect the stroke and measure its velocity approximately, a strobe, two color TV cameras to register clubhead parameters when the strobe flashes, a tethered golf ball to serve as the target of the stroke, and a computer-ontrolled support for the ball.
Figure 4:
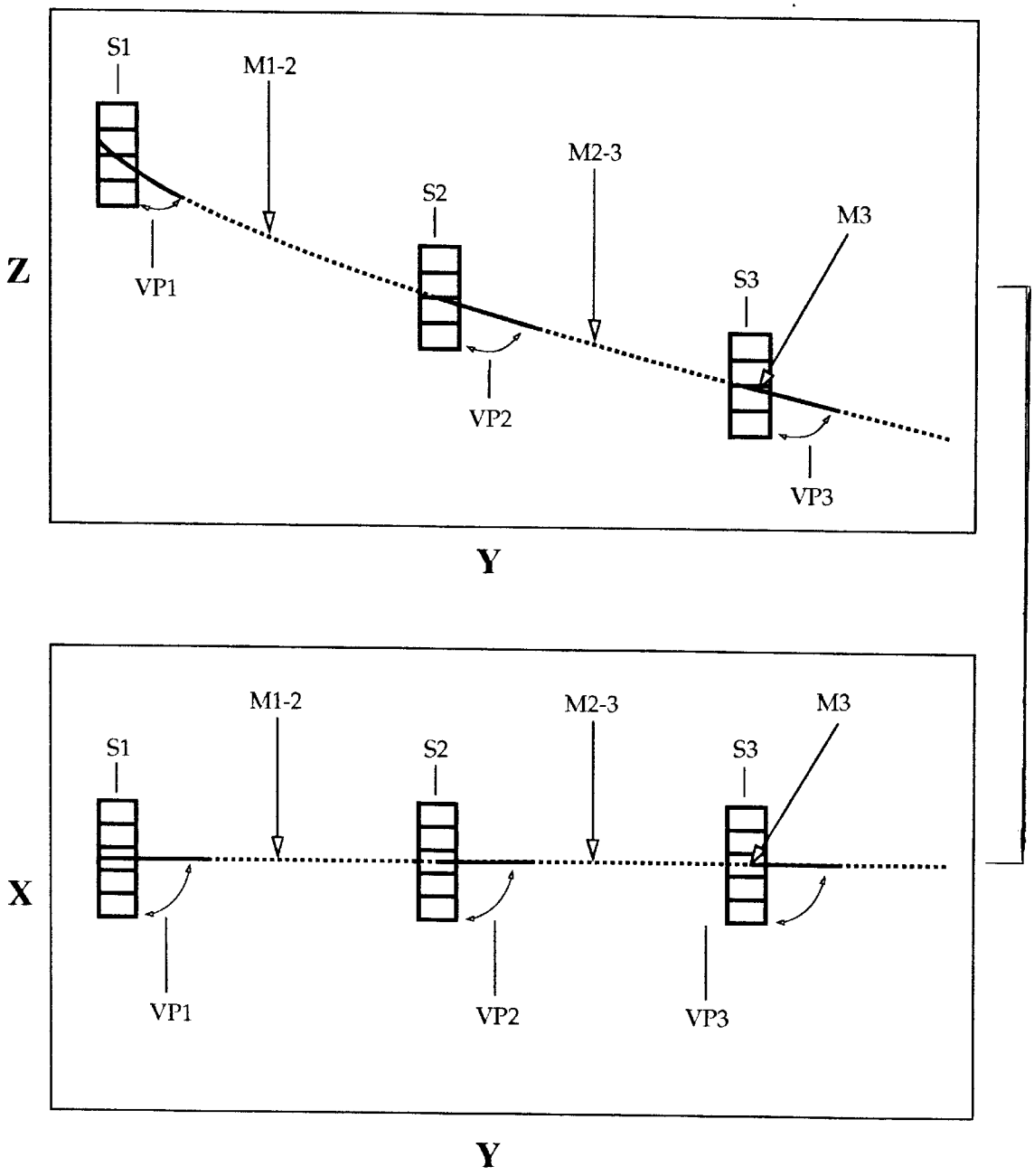
FIG. 4 shows the images of the clubhead bars on the X-Y and Y-Z TV color cameras produced by three strobes of a typical golf stroke.
Figure 5:
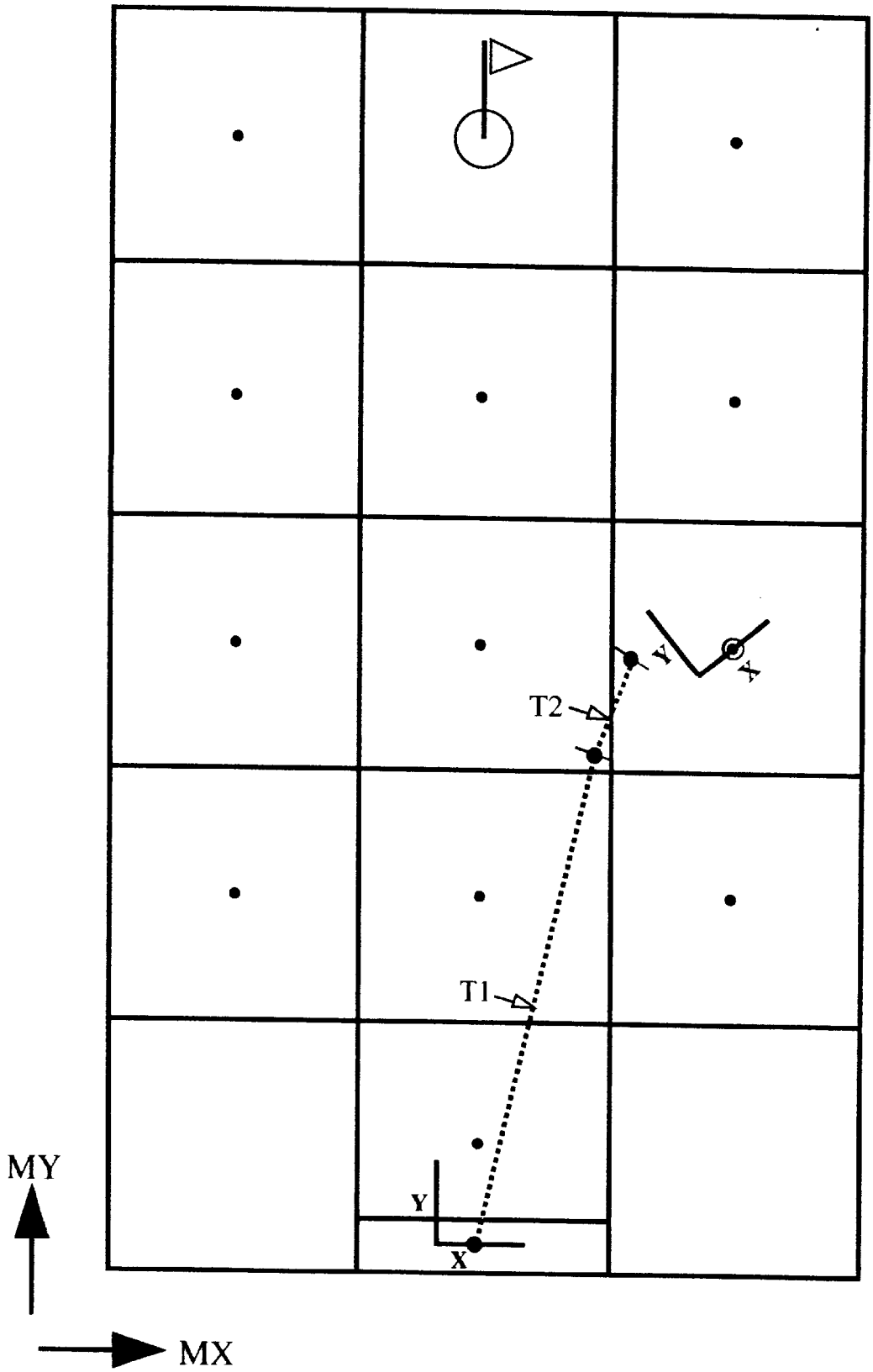
FIG. 5 represents in much simplified form a typical topographic map of a golf hole stored digitally in the computer. The ground track of a typical shot from the tee is also shown, as are the effective X-Y axes of the stroke measurement system at the location of the next shot.

FIGS. 3, 4, 5: The functions separately described in these figures are more apparent if their interrelationships are briefly described.

The locations and color sequences of the images on each TV tube produced by the strobe flashes are converted locally into digital data and transmitted to the central computer. The computer analyzes the relative positions and angles of the images to generate data describing clubhead parameters as it strikes the ball. These plus parameters. The total ball trajectory consists of a series of mini-trajectories. T1 is the initial flight, T2 the first bounce, etc. T1 is determined by the stroke parameters and the effect of wind. T2 is determined by the terminal conditions of T1 including ball spin, sector types such as fairway, rough, trap or green, sector degree and direction of slope, and course condition—hard, moderate or soft. T3 is determined by the terminal conditions of T2 and the other parameters listed.

When the final position of the ball is within a given terrain sector, within the computer the ball is placed at that sector viewpoint for the next shot. When the player is next up, the view on the screen provided by the video storage unit under computer control changes to the view toward the hole from that viewpoint.

This procedure requires manipulation of data in three coordinate systems. The stroke measurement data are with respect to the axes of the X-Y and Y-Z axes of the TV tubes. Their significance with respect to the map depends on the location and orientation of these axes with respect to the map. Since this is known, the data with respect to the camera axes determining the initial trajectory can be converted to the map axes to compute the ball's total trajectory and final location on the map.

Since the view toward the hole on the screen corresponds to the simulated position of the stroke measurement system on the map, the screen and TV axes are the same except that the screen axes are in perspective. The trajectory data calculated with respect to the axes of the map are converted to the same data with respect to the screen image and transformed into the movement of a light spot on the screen simulating in time the ball's trajectory as it would be seen by the golfer. Another approach is to convert both map and measurement system axes to screen axes before the stroke and compute accordingly. Which technique is used is a matter of mathematical and computational convenience.

FIG. 3: The stroke measurement subsystem consists of a clubhead sensor assembly (3-1, 3-2) a stroboscope (3-3), a transparent plate (3-4), two TV color cameras (3-5, 3-6), and a tethered ball (3-7) on a computer-controlled support (3-8) surrounded by artificial grass.

The clubhead sensor assembly consists of two photocell sensors, (3-1, 3-2), logic and an electronic clock. The clubhead backswing photocell signal sequence, 3-2 - 3-1, is used by the logic component to trigger the two TVs for one sweep to delete optical noise and to reset the clock. The forward swing signal sequence, 3-2 - 3-1, operates through the logic unit to start and stop the electronic clock. Since the clock counts down from perhaps 1000 at perhaps a rate of 1 kHz, its final value is a measure of clubhead velocity.

Clubhead velocity can range from perhaps 75 m/sec to 1 m/sec. For maximum measurement accuracy it is desirable to use the full field of view of the TV cameras regardless of clubhead velocity. For this reason a strobe control uses the clock count supplied by the clubhead sensor assembly to trigger flashes when, for all velocities, the clubhead is in approximately the same three positions with respect to the transparent plate. Assuming that the transparent plate extends about 44 cm along the Y axis, three flashes could be located at 10 cm intervals with a 6 cm margin at the rear and an 8 cm margin at the forward end to allow for clubhead acceleration. The flash durations, inversely proportional to clubhead velocity, are such as to produce an image width on the TV tubes equivalent to perhaps 3 mm along the Y axis of the plate.

The strobe and cameras may operate operate outside the visible spectrum. The stroboscope function may also be achieved by using a continuous beam of light from the stroboscope location and using the velocity datum from the clubhead sensor assembly to control the gating times of the TV cameras.

The X-Y TV camera (3-5), located perhaps 75 cm below the transparent plate, registers clubhead positions in the horizontal plane. The Y-Z TV camera (3-6), located perhaps 75 cm from the side of the transparent plate away from the golfer, registers clubhead positions in the vertical plane. For left-handed golfers the Y-Z camera could be pressed into the floor, causing a coresponding camera to rise on the other side of the plate. The fields of view of the two cameras intersect to form a measurement volume perhaps 45×45×45 cm.

Immediately after the third flash the two TV cameras are scanned, one after the other, along the Y axis. The location of each pulse is defined by the scan line, X or Z value, and the time within the scan line, Y value, at which it is encountered. A digitizer converts these to the appropriate digital format. Each pulse color value, also converted to a digital signal, is addded as a tag to the pulse data. To eliminate unneeded data, after each pulse return further returns are ignored for a time equivalent to perhaps 5 cm of line scan of the transparent plate. All data plus strobe frequency are transmitted to the computer.

The tethered golf ball (3-7) is mounted on a computer-controlled support (3-8). Its vertical position is above, on, or at different depths in the surrounding "grass" depending on whether the stroke is to be from the tee, the fairway, the rough or a trap. When hit, the support transmits a signal to the central computer to confirm that a stroke has in fact been made. After the stroke the ball is automatically returned to its position on the support.

FIG. 4; The nomenclature for this Figure is:

S1, S2, S3 The images formed on the two TV tubes by the strobe flashes

M1-2, M2-3 Computed curve connecting the midpoints of S1, S2, S3. The two arcs are measured and analyzed to indicate the direction, velocity and, by comparing them, the accelerations of the clubhead in the horizontal and vertical planes. This curve also indicate the transverse and vertical location of the clubhead as it hits the ball.

VP The three images (S1, S2, S3) of the X-Y color bar should be perpendicular to the arc of clubhead travel in the X-Y TV tube. VP, the variation from perpendicularity, is the angle of hook or slice. In the Y-Z plane the arcs may or may not be parallel to the clubface pitch angle. Any variation by club type and brand is included in the stored data describing the club. The actual angle of the Y-Z color bar is compared to its nominal value to determine the actual clubface pitch angle. The values of VP (if any) at S1, S2, S3 in both X-Y and Y-Z planes are computed and the rates of change determined.

How these values are manipulated depends upon the degree of accuracy desired. For example, although the clubhead is moving in three dimensions it will probably be sufficient to compute its velocity and acceleration at S3 in the X-Y plane and multiply by a fudge factor of perhaps 1.05 to account for its velocity and acceleration in the Z plane. However, for maximum accuracy the curves connecting the midpoints in both planes can be combined to form an equation defining the clubhead trajectory in three dimensions. The arc of this trajectory can be computed and used to determine precise clubhead velocity and acceleration. These can be extrapolated from S3 to the ball. The values of clubhead location, direction, VP, and their accelerations are also extrapolated from the clubhead at S3 to the ball. The extrapolated locations of the X-Y and Y-Z color bar midpoints at time of contact define the lateral and vertical location of the clubhead at that time. The VP values indicate clubface hook/slice and pitch angles. The direction of clubhead travel indicates the initial direction of the ball trajectory, although this may be modified by clubface angles and horizontal and vertical clubhead position. The quantitative significance of these measurements on a golf ball's trajectory must be determined largely by experiment.

FIG. 5: The terrain of each hole is mapped into sectors. These can be defined by the locations of their vertices or by equations defining their sides. Within each sector is a viewpoint. When the final position of the ball is within a sector, a view toward the hole from that sector's viewpoint is displayed when that player is next up.

In addition to its boundary data, each sector is defined by data that include:

Precise location and orientation of its viewpoint, the ball's location for the next shot.

Type of terrain: Tee, fairway, green, rough, trap, water, woods.

Direction and degree of sector slope

If the viewpoint is in a trap or there are other obstacles, direction and elevation of the ball trajectory needed to emerge.

If the ball is in water or if it fails to emerge from a trap after two tries, the ball is repositioned at another viewpoint at the cost of an additional stroke.

Identification of screen view corresponding to viewpoint.

X and Y perspective equation(s) of view on TV screen.

In this figure T1 of the total trajectory terminates on the fairway, T2 in a rough sector. Also shown are the location of the resulting sector viewpoint and the orientation of the X-Y TV camera's measurement axes implicit in that viewpoint.

The total ball trajectory is computed in two ways for two purposes: the ground track to establish the ball's final position, the screen trajectory to show the ball's trajectory from the golfer's point of view. In the case of a stroke from the tee, the stroke measurement axes coincide with the map axes and the stroke parameters can be used directly to compute the ground track. When the stroke is from another viewpoint, the stroke parameters can be transposed from the position and orientation of that viewpoint to the corresponding values with respect to the map axes in order to compute the ground track.

The screen view must be related to the hole map in order to have the ball's screen trajectory reflect its terrain encounters. To do this, the hole map of that portion of the hole displayed on the screen can be first transposed to the viewpoint axes and thence to the screen axes. The viewpoint's X axis corresponds to the screen's horizontal dimension, the Y axis to the vertical dimension. However, both axes on the screen, like the view shown on the screen, are in perspective, and the axes of the transposed map in the computer must reflect this perspective. Alternatively, the hole map within the scope of the viewpoint may be transposed before the stroke to the viewpoint axes as seen in perspective on the screen and all trajectory computations made accordingly.

What is claimed is:

1. A golf simulator comprising:

a ball support, a golf clubhead comprising first and second color-segmented bars, a transparent plate horizontally behind said ball support over which said golf clubhead passes to hit a ball, one or more stroboscopic light sources configured to stroboscopically illuminate said golf clubhead a plurality of times during a portion of a golf swing, a first TV color camera positioned below or well above and substantially vertically to said transparent plate to generate multiple images of light reflected from said first color-segmented bar as said first color-segmented bar is multiply illuminated while passing over said transparent plate to hit a ball, a second color TV camera positioned substantially in approximately the same horizontal plane and at a right angle to the direction of clubhead travel over said transparent plate to generate multiple images of light reflected from said second color-segmented bar as said color-segmented bar is multiply illuminated while approaching the ball;

a computer coupled to said first and second color TV cameras configured to transform the colors, positions and orientations of the multiple images of the color-segmented bars on both color TV cameras into digital data representing a type and brand of golf club, direction of travel, orientation, velocity and accelerations of said golf clubhead so as to calculate a golf ball trajectory from said multiple images.

* * * * *